United States Patent [19]

Schmid

[11] Patent Number: 4,653,930

[45] Date of Patent: Mar. 31, 1987

[54] TIMEPIECE WITH SPECIAL AESTHETIC EFFECTS

[75] Inventor: Marlyse Schmid, Chézard, Switzerland

[73] Assignee: ETA S.A. Fabriques d'Ebauches, Grenchen, Switzerland

[21] Appl. No.: 839,672

[22] Filed: Mar. 14, 1986

[30] Foreign Application Priority Data

Mar. 18, 1985 [CH] Switzerland ..... 01189/85

[51] Int. Cl.[4] ..... G04B 19/20; G04B 19/06

[52] U.S. Cl. ..... 368/77; 368/232

[58] Field of Search ..... 368/76, 77, 223, 228, 368/232, 233, 234

[56] References Cited

U.S. PATENT DOCUMENTS

| | | | |
|---|---|---|---|
| 1,183,479 | 5/1916 | Meroz | 368/80 |
| 3,321,905 | 5/1967 | Krebs | 368/232 |
| 3,803,831 | 4/1974 | Horzik | 368/233 |
| 3,890,777 | 6/1975 | Spanish | 368/234 |

FOREIGN PATENT DOCUMENTS

| | | | |
|---|---|---|---|
| 66784 | 9/1957 | France . | |
| 284141 | 11/1952 | Switzerland . | |
| 309974 | 12/1955 | Switzerland . | |
| 321954 | 5/1957 | Switzerland | 368/233 |
| 321586 | 6/1957 | Switzerland . | |
| 1119637 | 7/1968 | United Kingdom | 368/234 |

*Primary Examiner*—Vit W. Miska

*Attorney, Agent, or Firm*—Pollock, Vande Sande & Priddy

[57] ABSTRACT

The face of the watch bears a design and has windows set in it in areas which do not affect the design itself. The disk which, in a normal watch, serves to display the day of the week, bears a design corresponding to the central portion of the design on the face. The ring which, in a normal watch, serves to display the date, bears a design corresponding to the portion of the face design which is not on the disk. Owing to this arrangement the design on the face only appears every 217 days without a parasitic image being present in the windows. The rest of the time the disk and the ring cause portions of the design to appear in the windows which give a confused overall appearance.

9 Claims, 3 Drawing Figures

TIMEPIECE WITH SPECIAL AESTHETIC EFFECTS

FIELD OF THE INVENTION

The present invention relates to timepieces providing special aesthetic effects. More particularly, it relates to a timepiece in which these special effects are obtained by means of the indicator members themselves.

BACKGROUND OF THE INVENTION AND PRIOR ART

It has long been known to add an attractive or original function to the functions of time indication in a timepiece, such as a watch or clock, by causing the appearance of the timepiece to change when the course of time according to the relative position of the indicator members.

Swiss Pat. No. 354 031, for example, describes a timepiece comprising, between the face and the glass, two transparent disks with zones having a polarizing effect. One of the disks is fixed to the glass, while the other is firmly connected to the second-hand shaft. The relative movement of the polarizing zones causes a play of light and shadow on the face.

The watch described in Swiss Pat. No. 429 599 also comprises two polarizing disks. One of them is positioned on an image carried by the face and the other is mounted on the second-hand shaft. When the second-hand shaft rotates the image appears and disappears.

In the watch according to Swiss Pat. No. 512 770 the face and a transparent disk mounted on the second-hand shaft are provided with designs of predetermined colours and patterns which cooperate with each other to produce special optical effects when the disk rotates.

BRIEF DESCRIPTION OF THE INVENTION

The object of the present invention is to provide a timepiece which allows a given image to appear periodically, as do the embodiments mentioned above. A more specific object is to provide a timepiece with novel means used to form the said image.

The timepiece according to the invention has a stationary face with at least one transparent zone. A movement rotates at least one display member which is located behind the face. The display member bears a motif which cooperates with the face to form a predetermined decorative design. This takes place only when the display member is in a single, predetermined position relative to the face. The decorative design is independent of the time display and independent of any other phenomenon connected with the time.

DESCRIPTION OF THE DRAWINGS

The characteristics and advantages of the present invention will become apparent from the following description, made with reference to the attached drawings and giving, by way of explanation which is in no way limiting, several embodiments of such a timepiece. In these drawings.

DESCRIPTION OF BEST MODE AND OTHER EMBODIMENTS

Figure 1:
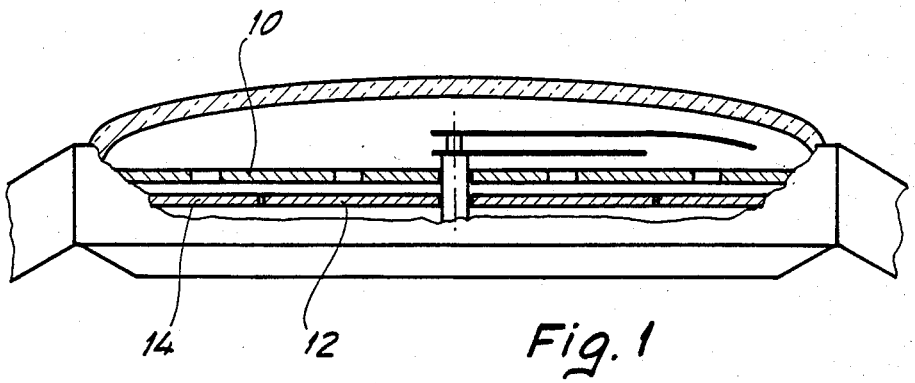
FIG. 1 is a diagrammatic representation of a watch according to the invention.

FIG. 1 shows a watch with an analog display comprising, in a conventional manner, a coplanar and concentric disk 12 and ring 14 under its face 10. In a normal watch these two components constitute respectively the disk allowing the days of the week to be displayed and the ring allowing the date to be displayed. These two members are driven by the movement of the watch and advance by one step per day. Their drive system is not shown in the Figure as it is identical in every respect to that which, in a normal watch, drives the calendar members. Thus, the disk 12 and the ring 14 effect a complete revolution in seven and thirty-one days respectively.

Figure 2:
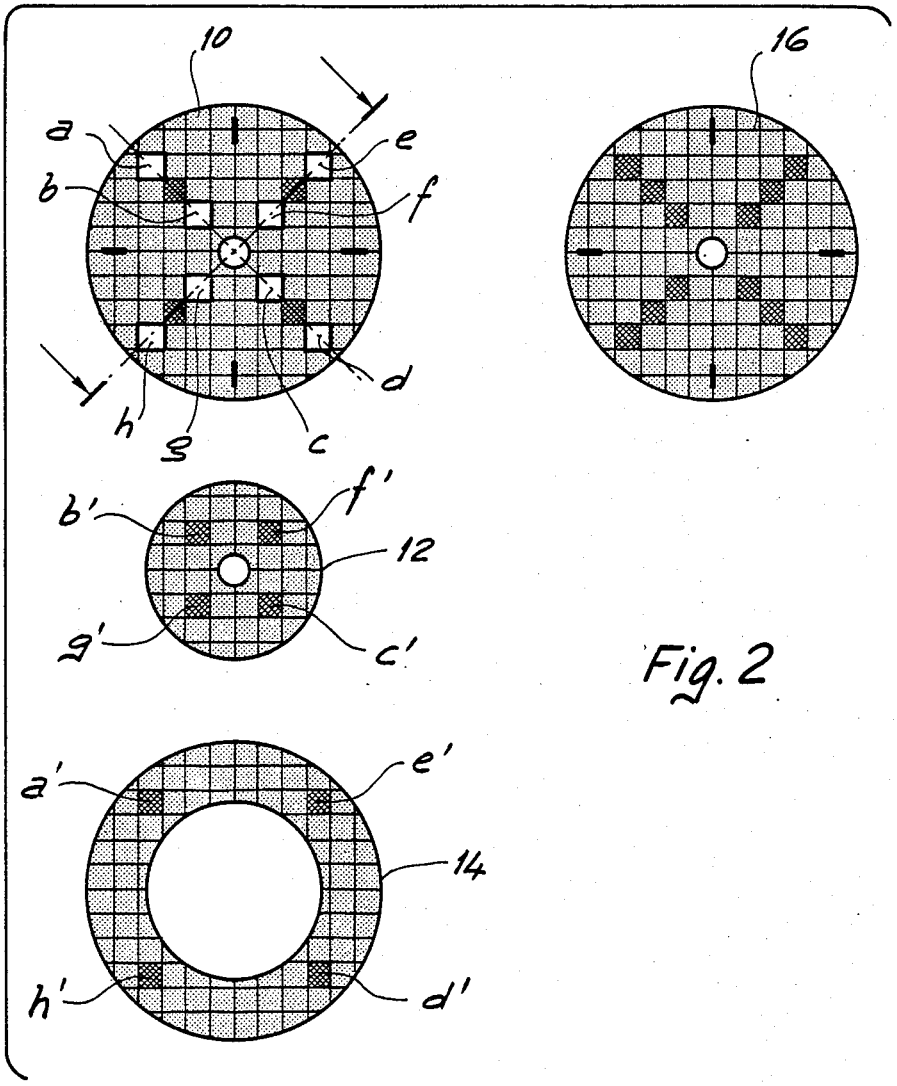
FIGS. 2 and 3 show two variants of the essential components which enable this watch to provide special aesthetic effects.

Reference will now be made to FIG. 2, in which there may be seen, side by side, respectively the face 10, the disk 12 and the ring 14, according to a first embodiment of the invention.

The face 10 bears a design which is formed, in the simple example shown, of two perpendicular networks of parallel, equidistant lines. Along the two perpendicular lines which divide each of the sectors of the face into two equal portions eight of the squares which make up the pattern, divided into four symmetrical pairs, two per sector, are replaced by transparent windows indicated by the reference characters a to h. The other squares along these two lines have a different colour from the rest of the face.

The disk 12 bears a design made up of a pattern identical to that of the face 10. The squares b', c', f', g' of this design correspond in their positions respectively to the windows b, c, f, g on the face and are coloured in the same way as the squares on said face.

Similarly, the ring 14 bears a design of the same pattern as the face and the disk. The squares a', d', e' and h' of this design correspond in their positions respectively to the windows a, d, e and h on the face and are coloured in the same way as the squares on said face.

Thus, since the disk 12 and the ring 14 make a complete revolution in seven and thirty-one days respectively, every 217 days ($31\times7$) these two members will be in a position where their coloured motifs b', c', f', g' and a', d', e', h' respectively will appear simultaneously in the windows in the face. In FIG. 2 there is shown at 16 the complete image which will be formed every 217 days by the cooperation of the motifs on the disk 12 and the ring 14 with the motif carried by the face 10.

The embodiment shown in FIG. 1 is only one of the numerous examples which illustrate how, within the framework of the present invention, a design can be re-formed at regular intervals by motifs carried by the mobile members 12 and 14 and the stationary face 10.

Of course, the designs may be infinitely varied, as may the shape, position and number of windows in the face. Thus it is possible, for example, to have merely a single window in which the two mobile members periodically re-form an image. Another possibilty would be to leave the face without any design. Thus, in the case of FIG. 1, the face could comprise only the eight windows a to h which would allow the squares of colour carried by the two mobile members to appear simultaneously at regular intervals.

In a simplified version a single mobile member may be used, for example the disk 12 alone, the ring 14 alone or a larger disk formed by joining together the disk 12 and the ring 14.

Furthermore, it is not necessary for all the squares to be similarly coloured. Moreover, the windows in the face may be tinted in such a way that when the squares coincide their colouring results from the combination of the colours of the windows and of the two mobile members.

Figure 3:
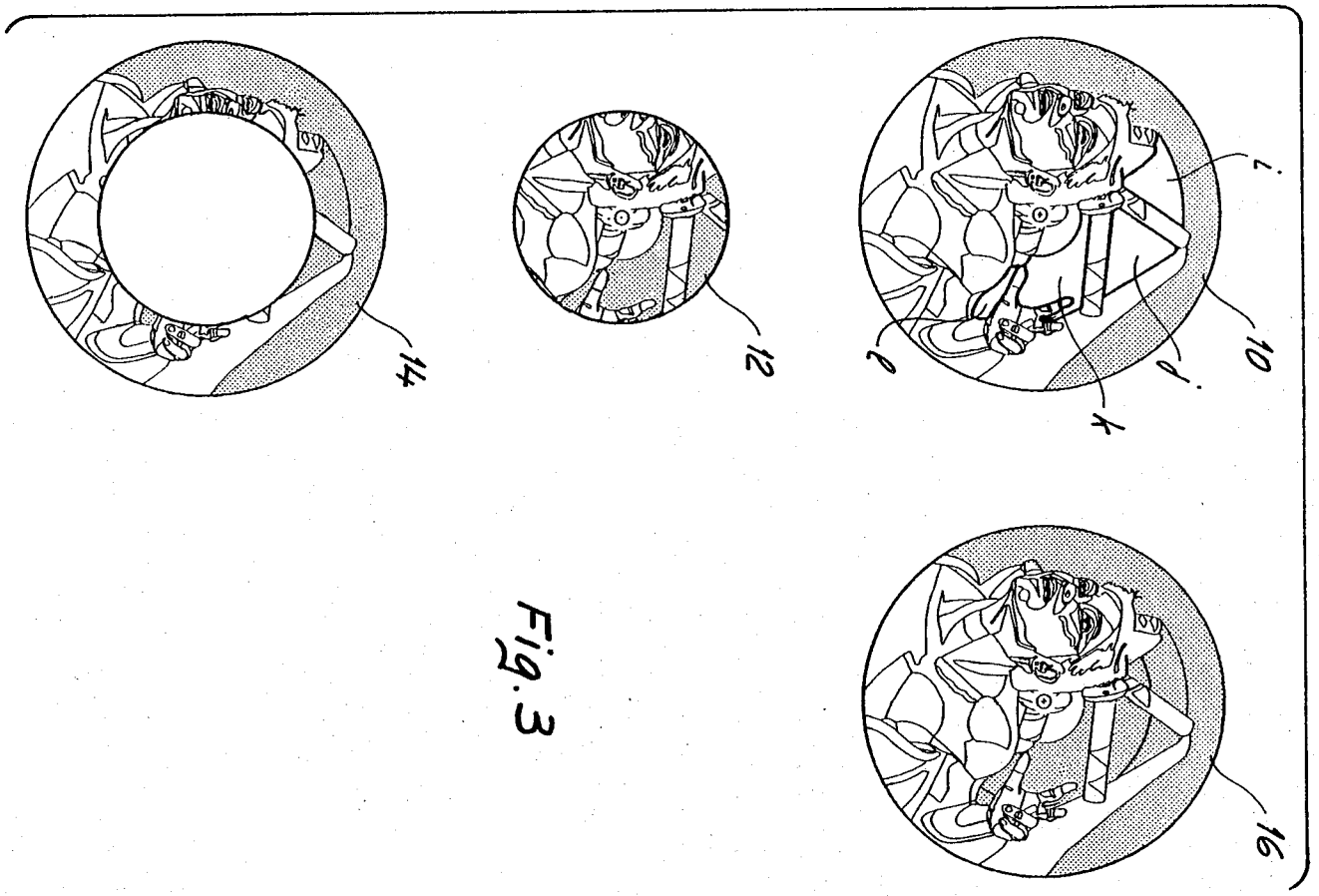

Reference will now be made to FIG. 3, which shows another embodiment of the invention. In this case the face 10 bears a design and has a series of windows i, j, k and l set in it in areas which do not affect the design itself. The disk 12 carries a design corresponding to the central part of the design on the face, while the ring 14 bears a design corresponding to that part of the face design which is not on the disk.

In this case, if, as previously, the disk 12 and the ring 14 make a complete revolution in seven and thirty-one days respectively, the design on the face will only appear every 217 days without a parasitic image being present in the windows. The image obtained is indicated in FIG. 3 by the reference numeral 16. The rest of the time the disk 12 and the ring 14 will present portions of the design in the face windows which will give a confused appearance to the whole thing.

Of course the system according to FIG. 3 may also be simplified by the use of a single mobile member, which would then allow a clear design, without a parasitic image, to be obtained every seven or thirty-one days.

Another interesting possibility would be to use a completely transparent face on which there has simply been drawn the outline of the design, without any colouring. A clear image would then only appear when this arrangement design was superimposed precisely over the coloured design re-formed by the disk and the ring. This colourless design could also be located on the inner surface of the face.

Of course, numerous variants of the invention are possible, since the aim sought is a special aesthetic effect which therefore involves colours and shapes. It goes without saying, that without going beyond the scope of the invention the speeds at which the disk and the ring are driven may differ from those described. The disk could, for example, be driven at a rate of one full revolution per week and the ring at a rate of one revolution per day. In this case the coincidence would recur every seven days. Numerous other combinations are made possible by driving one of the members even faster, for example at the rate of one revolution per hour.

I claim:

1. A timepiece comprising a movement, a stationary face having at least one transparent zone and bearing a first decorative design, a display member driven rotationally by said movement and located behind said face, said member bearing a second decorative design which is substantially identical to the design on said face and is positioned so that the decorative design on the face appears without a parasitic image in said transparent zone only when said two designs are exactly superimposed.

2. A timepiece according to claim 1 wherein said display member makes a complete revolution in seven days and is driven by a drive system identical to that for driving a display disk for the days of the week in a conventional timepiece.

3. A timepiece according to claim 1 in which said display member makes a complete revolution in thirty-one days and is driven by a drive system identical to that for driving a date display ring in a conventional timepiece.

4. A timepiece comprising a movement, a stationary face having at least one transparent zone and bearing a motif, first and second display members driven rotationally at different speeds by said movement and located behind said face, said members being formed respectively by a disk and a ring and bearing respective motifs which, when the members are in a predetermined position in relation to each other and to said transparent zone, cooperate with the motif on the face to form a predetermined decorative design.

5. A timepiece according to claim 4 wherein said disk makes a complete revolution in seven days and said ring makes a complete revolution in thirty-one days and are driven by a drive system identical to that for driving a display disk for the days of the week and a date display ring in a conventional timepiece.

6. A timepiece comprising a movement, a stationary face having at least one transparent zone and bearing a decorative design, first and second display members driven rotationally at different speeds by said movement and located behind said face, said members being formed respectively by a disk and a ring and bearing respective motifs which, when the members are in a predetermined position in relation to each other, cooperate to form a design which is substantially identical to the decorative design on said face, said motifs being positioned so that the decorative design on said face appears without a parasitic image in said transparent zone only when the decorative design on said face and the design formed by cooperation of said motifs are exactly superimposed.

7. A timepiece according to claim 6 wherein said disk makes a complete revolution in seven days and said ring makes a complete revolution in thirty-one days and are driven by a drive system identical to that for driving a display disk for the days of the week and a date display ring in a conventional timepiece.

8. A timepiece according to claim 4 in which said ring is concentric to said disk.

9. A timepiece according to claim 6 in which said ring is concentric to said disk.

* * * * *